United States Patent [19]

Pringle

[11] Patent Number: 4,510,994

[45] Date of Patent: Apr. 16, 1985

[54] PUMP OUT SUB

[75] Inventor: Ronald E. Pringle, Houston, Tex.

[73] Assignee: Camco, Incorporated, Houston, Tex.

[21] Appl. No.: 597,285

[22] Filed: Apr. 6, 1984

[51] Int. Cl.[3] ..... E21B 34/10

[52] U.S. Cl. ..... 166/156; 166/317; 166/193

[58] Field of Search ..... 166/156, 153, 317, 318, 166/193, 194, 383, 386, 192, 214; 137/68 R; 277/71, 84, 87, 187, 189.5

[56] References Cited

U.S. PATENT DOCUMENTS

| | | | |
|---|---|---|---|
| 3,051,244 | 8/1962 | Litchfield | 166/317 |
| 3,090,442 | 5/1963 | Cochran et al. | 166/318 X |
| 3,131,767 | 5/1964 | Chancellor et al. | 166/156 |
| 3,713,490 | 1/1973 | Watson | 166/318 X |
| 4,260,017 | 4/1981 | Nelson et al. | 166/318 X |
| 4,292,988 | 10/1981 | Montgomery | 166/318 X |

*Primary Examiner*—Stephen J. Novosad
*Assistant Examiner*—Thuy M. Bui
*Attorney, Agent, or Firm*—Fulbright & Jaworski

[57] ABSTRACT

A pump out sub for use in a well tubing for receiving a plug for sealing the tubing and applying pressure to the tubing for actuating a well device and thereafter applying a higher pressure to pump out the plug and open the bore. A circular ring is connected in a recess in the bore of the body by shear pins. An expandable seat is positioned in a second recess above the first recess and extends into the bore for receiving a plug and is positioned above and supported from the circular ring. When a plug is seated on the seat pressure may be applied to the tubing for actuating well tools. Thereafter additional pressure is applied to the plug and the ring and the seat moves downwardly and the seat expands into the first recess and out of the bore.

8 Claims, 4 Drawing Figures

PUMP OUT SUB

BACKGROUND OF THE INVENTION

In a well it is sometimes desirable to apply pressure internally of a well tubing for actuating various equipment such as setting hydraulic packers. It is common to use a pump out sub which receives a plug for blocking off the well tubing whereby hydraulic pressure can be applied to the well tubing for actuating an apparatus. After the apparatus is actuated, the tubing pressure is increased to clear the bore of the pump out plug.

The present invention is directed to an improved pump out sub. The present invention is directed to a simple, uncomplicated but effective pump out sub which accomplishes the function of receiving a plug to seal the well tubing for pressuring up the tubing to actuate a well tool. Thereafter increased pressure is applied to clear the internal bore and avoid any restrictions therein and to provide a minimum amount of debris in the well.

SUMMARY

The present invention is directed to a pump out sub for use in a well tubing for receiving a plug from the well surface for sealing the tubing whereby the well tubing can be pressured up. Thereafter, upon increased pressure, the plug may be pumped out. A tubular body is provided which is adapted to be connected in the well tubing. The body includes a first recess with shearable means positioned in the recess. An expandable seat is positioned in the body above and is supported from the shearable means whereby when a plug is seated on the seat pressure may be built up in the tubing for actuating equipment. After the equipment is actuated additional pressure may be applied to the plug to shear the shearable means, and move the seat and shearable means downwardly to allow the seat to expand into the recess.

Still a further object of the present invention is wherein the seat is generally a C-shaped spring steel ring having a molded seal.

Yet a further object is wherein the shearable means includes a circular ring connected to the body by one or more shear pins.

Still a further object of the present invention is wherein the first recess is of an axial extent to receive and hold both the shearable circular ring and the seat.

Yet a further object of the present invention is wherein the shearable means is positioned in the first recess and extends radially inwardly only as far as the interior of the wall. The body includes a second recess positioned above the first recess and the expandable seat is positioned in the second recess and extends into the bore of the body for receiving a plug. Thus, when the shearable means is sheared, the seat and the shearable means move downwardly and the seat expands into the recess and out of the bore.

Other and further features, objects and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1:
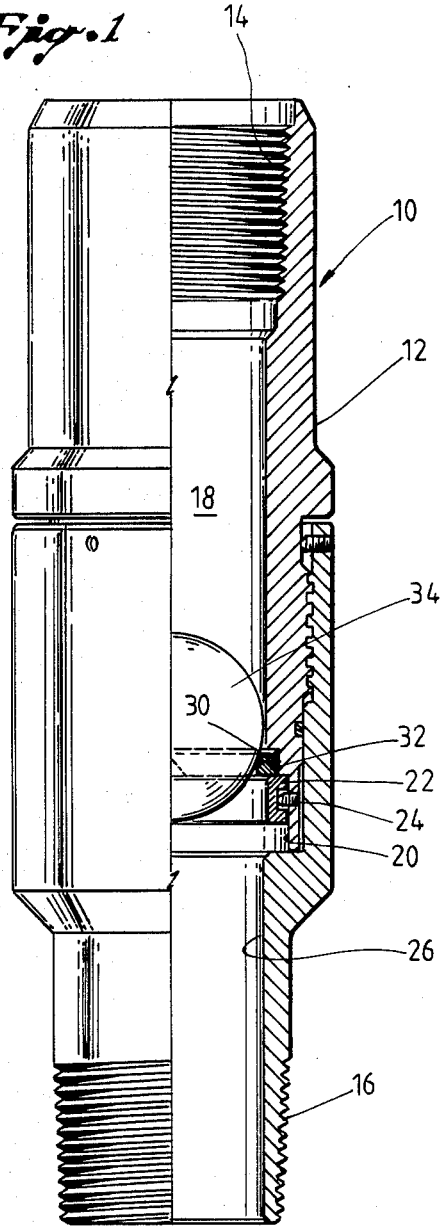
FIG. 1 is an elevational view, partly in cross section, of the pump out sub of the present invention with a plug seated in position.
Figure 3:
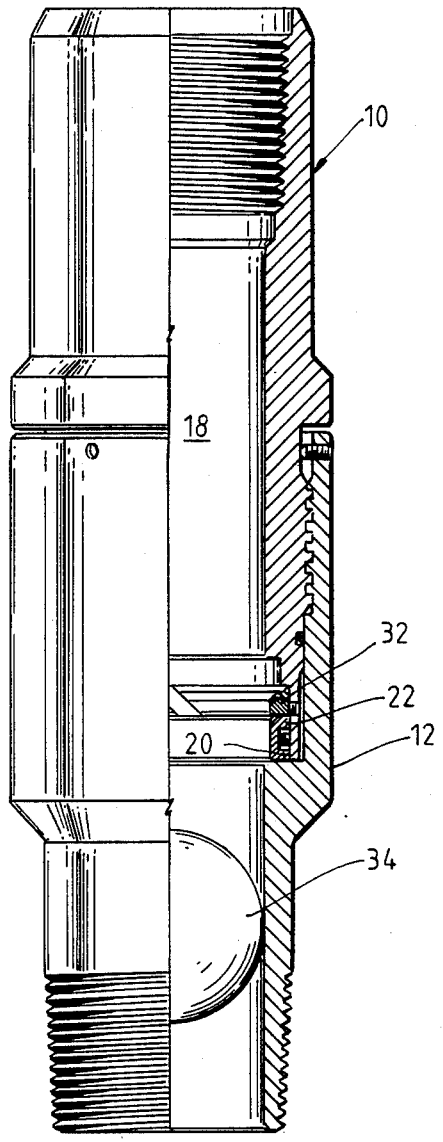
FIG. 3 is a view similar to FIG. 1 but illustrating the position of the parts of the invention after the plug is pressured up and pumped through the seat ring.

Referring now to the drawings, and particularly to FIGS. 1 and 3, the reference numeral 10 generally indicates the pump out sub of the present invention and includes a body 12 having suitable connections 14 and 16 such as threads for connecting the body 12 in a well tubing. The body 12 includes a bore 18 generally of the same size as the bore of the well tubing (not shown) to which the body 12 is connected.

Figure 2:
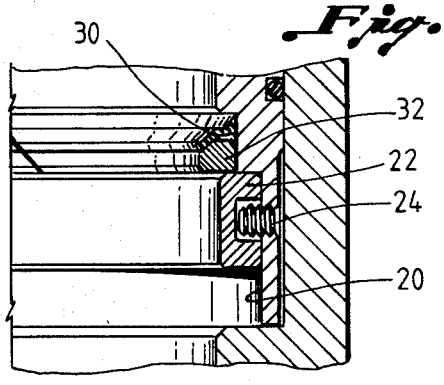
FIG. 2 is a fragmentary enlarged elevational view illustrating the position and interaction of the seat ring and shear ring.

Referring now to FIGS. 1–3, the body includes a first recess 20. Shearable means, such as a shear ring 22, which is connected to the body 12 by one or more shear pins 24 is provided positioned in and at the top of the recess 20 and extends radially inwardly only as far as the interior wall 26 of the body 12. Therefore, the ring 22 does not extend into, block, or interfere with tools moving through the bore 18 of the body 12.

The body includes a second recess 30 positioned above the first recess 20. The second recess 30 does not extend radially outwardly as far as recess 20. An expandable seat 32 is positioned in the second recess 30 and extends into the bore 18 of the body 12 for receiving a plug 34 such as a ball. The expandable seat 32 is positioned above and is supported from below by the shear ring 22. Thus, the first recess 20 and the second recess 30 allow the expandable seat 32 to protrude into the bore, and allow the shear ring 22 to support the expandable seat 32, but yet the shear ring 22 does not protrude into the bore 18. It is to be noted in FIGS. 1–3 that the axial length of the first recess 20 is greater than the width of the shear ring 22 and seat 32. After the plug 34 is set and the pressure in the tubing above the pump out sub 10 is raised to perform its desired purpose, the pressure is increased and the ball 34 moves downwardly by shearing the pins 24. Downward movement of the ball 34 carries the seat 32 and the shear ring 22 downwardly. As best seen in FIG. 3, the shear ring 22 moves down to the bottom of the recess 20 leaving a space in the recess 20 above the shear ring 22 into which the expandable seat 32 expands. As shown in FIG. 3, the expandable seat 32 no longer protrudes into the bore 18 and therefore there is no further restrictions in the bore 18 to impede the movement of well tools through the pump out sub 10. The plug 34 moves through the expanded seat 32 and out the bottom end of the sub 10.

Figure 4:
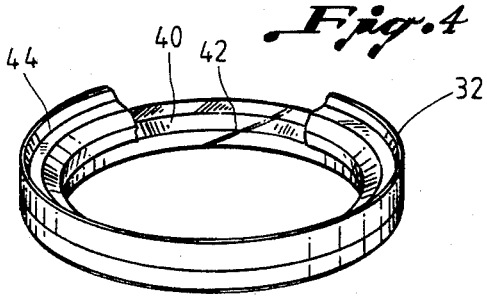
FIG. 4 is an enlarged perspective view, partly cut away, illustrating the seat ring of the present invention.

Referring now to FIG. 4, while the expandable ring may be of any suitable material to form a suitable seal and to be biased in an outward direction when released, preferably, the expandable seat 32 includes a C-shaped spring steel ring 40 which is split such as with a skive cut 42 whereby the spring steel ring may expand when it moves out of the first recess 30 into the second recess 20. If desired, for providing a better sealing surface, the ring 40 may be coated or molded with a resilient material such as rubber 44. In one embodiment, the rubber 44 may be bonded over the ring 40 which is held in a clasped position to retain the finished ring 32 in its collapsed position and thereafter allow the rubber to be broken as the ring is expanded as it is moved downwardly by the force of the ball 32. Or, the metal ring 40 may be coated with the coating 44 while it is in the expanded position leaving a gap in the cut 42. The ring 32 is then compressed to fit into the recess 30 and upon shearing of the shear pins 24 will readily expand outward into the recess 20.

In use, the pump out sub 10 is connected in a well tubing below the equipment or apparatus to be actuated such as a hydraulically set well packer. Thereafter, when it is desired to actuate the well packer, the plug or ball 34 is dropped down the well tubing and will seat on the expandable seat 32 which protrudes out into the bore 18. The well tubing is then pressured up to the necessary pressure to actuate the well packer. After the packer is set, an additional higher pressure is applied to the well tubing sufficient to shear the pin or pins 24. After the pins 24 shear, the plug 34 moves both the seat 32 and the shear ring 22 downwardly in the recess 20. The outwardly expandable seat 32 will then expand into the larger recess 20 to move out of the bore 18 and allow the plug or ball 34 to pass through and out the bottom end of the well tubing. Thereafter, the pump out sub 10 does not restrict the bore 18.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. A pump out sub for use in a well tubing for receiving a plug for sealing the tubing and applying pressure to the tubing and thereafter pumping out the plug comprising, a tubular body adapted to be connected in the well tubing, said body including a recess, shearable means positioned in the recess, an expandable seat positioned in the body above and supported from the shearable means whereby when the plug is seated on the seat pressure may be applied to the tubing and when sufficient pressure is applied to the plug the shearable means and the seat moves downwardly and the seat expands into the recess.

2. The apparatus of claim 1 wherein the seat is generally a C-shaped spring steel having a molded seal.

3. The apparatus of claim 1 wherein the shearable means includes, a circular ring connected to the body by shear pins.

4. The apparatus of claim 1 wherein the recess is of an axial extent to hold both the shearable means and the seat.

5. The apparatus of claim 4 including a second recess above the first recess for receiving the seat.

6. A pump out sub for use in a well tubing for receiving a plug for sealing the tubing and applying pressure to the tubing and thereafter pumping out the plug comprising, a tubular body having an open bore adapted to be connected in the well tubing, said body including a first recess, shearable means positioned in the first recess and extending inwardly only to the interior wall of the body, said body including a second recess, positioned above the first recess, an expandable seat positioned in the second recess and extending into the bore of the body for receiving a plug and positioned above and supported from the shearable means, said first recess being of a size to accommodate both the shearable means and the expandable seat whereby when a plug is seated on the seat pressure may be applied to the tubing and when sufficient pressure is applied to the plug the shearable means and the seat move downwardly and the seat expands into the first recess and out of the bore.

7. The apparatus of claim 6 wherein the seat is generally a C-shaped spring steel having a molded seal.

8. The apparatus of claim 6 wherein the shearable means includes, a circular ring connected to the body by shear pins.

* * * * *